US005429171A

United States Patent [19]

Hamilton

[11] Patent Number: 5,429,171

[45] Date of Patent: Jul. 4, 1995

[54] FLEXIBLE PARTITION

[76] Inventor: Roy S. Hamilton, 1460 Lakeshore, Dorval, Quebec, Canada, H9S 2E7

[21] Appl. No.: 66,500

[22] Filed: May 24, 1993

[51] Int. Cl.[6] ..... A47H 1/00

[52] U.S. Cl. ..... 160/243; 160/122; 160/268.1; 160/310

[58] Field of Search ..... 160/243, 244, 245, 242, 160/121.1, 122, 268.1, 310, 41

[56] References Cited

U.S. PATENT DOCUMENTS

| | | | |
|---|---|---|---|
| 1,307,729 | 6/1919 | Dunlop | 160/121.1 |
| 3,521,693 | 7/1970 | Kuss | 160/243 |
| 3,537,504 | 11/1970 | Deane | 160/243 |
| 3,693,695 | 9/1972 | Deane | 160/243 |
| 4,436,137 | 3/1984 | Charles | 160/242 |
| 4,480,675 | 11/1984 | Berkemeier | 160/121.1 |
| 4,987,942 | 1/1991 | Eriksson | 160/243 |
| 5,195,594 | 3/1993 | Allen et al. | 160/243 X |

*Primary Examiner*—David M. Purol
*Attorney, Agent, or Firm*—Wolf, Greenfield & Sacks

[57] ABSTRACT

A flexible partition suspended from a ceiling of a gymnasium or the like. The flexible partition includes a drive cylinder which extends the length of and intermediate the curtain forming the partition. The cylinder is provided with a drive motor internally of the cylinder, and a reaction device is provided externally of the curtain such that the motor device when activated will drive the cylinder to wind up the upper and lower portions of the curtain. The upper and lower portions of the curtain are attached at diametrically opposed locations on the cylinder, and hook and loop type fastening strips are provided on the edges of the curtain and the side walls so as to seal the curtain against noise or dust.

4 Claims, 4 Drawing Sheets

FLEXIBLE PARTITION

BACKGROUND OF THE INVENTION

1. Field of the Invention

The present invention relates to a flexible partition, and more particularly, to a curtain with an integrated wind-up device.

2. Description of the Prior Art

It is well known to utilize flexible sheet type curtains, which are adapted to be rolled up, to divide or partition a large room such as a gymnasium. Such curtains might easily measure 40 feet in length by 20 feet in height. In most cases, an electric motor drives a shaft on which the curtain is hung. Such an apparatus is described in U.S. Pat. No. 3,900,063, issued Aug. 19, 1975 to Max F. Roller. As can be seen in the Roller patent, the installation of such a curtain may be relatively involved since the motor and roll-up device must be mounted to the trusses or rafters supporting the ceiling. The torque required to wind up the complete curtain is substantial, thereby increasing the height of the wind-up installation.

A further disadvantage of current flexible partition wall systems is that they do not lend themselves to being properly sealed against dust or noise. In other words, there is no suitable device for sealing the vertical edges of the curtain against the walls forming the enclosure or room which is being divided by the curtain when it is deployed.

SUMMARY OF THE INVENTION

It is an aim of the present invention to provide an improved, relatively light, flexible partition for dividing large rooms such as gymnasiums.

It is a further aim of the present invention to provide a flexible partition which is simpler to install.

It is a still further aim of the present invention to provide a flexible partition which can completely divide a room and be sealed against the lateral walls defining the room so as to reduce the transmission of sound or dust between the two divided portions.

A construction in accordance with the present invention comprises a flexible partition for dividing a room wherein the room includes a ceiling, a floor and vertical side limiting means defining a vertical planar area. The flexible partition has dimensions to cover the vertical planar area and includes a curtain with a top edge, means for suspending the curtain from the ceiling, a bottom edge touching the floor when the curtain is fully deployed, and side edges in contact with the respective vertical limiting means. An elongated cylinder extends from one side edge to the other and is fixedly connected to the curtain and divides the curtain in upper and lower portions. A motor means is located with at least one end of the cylinder, at one edge of the curtain, rotary drive means is mounted within the cylinder and is driven by the motor means to rotate the cylinder, and torque reacting means is provided adjacent the one edge of the curtain and associated with the motor means to resist rotation of the motor means with the cylinder in response to rotation of the rotary drive means whereby the upper and lower portions of the curtain will be wound up on the cylinder when it is required to roll up the curtain.

More specifically, the cylinder includes a circular cross-section interrupted by diametrically opposed grooves. Beads are provided at a lower edge of the upper portion and an upper edge of the lower portion for fitting and locking into the respective diametrically opposed grooves such that the cylinder is bisected by a common plane of the upper and lower portions of the curtain when the curtain is fully deployed.

In a still more specific embodiment of the present invention, the side edges of the curtain and the respective side limiting means are each provided with elongated cooperating hook and loop type fastening strips in order to seal the side edges of the curtain when it is deployed.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
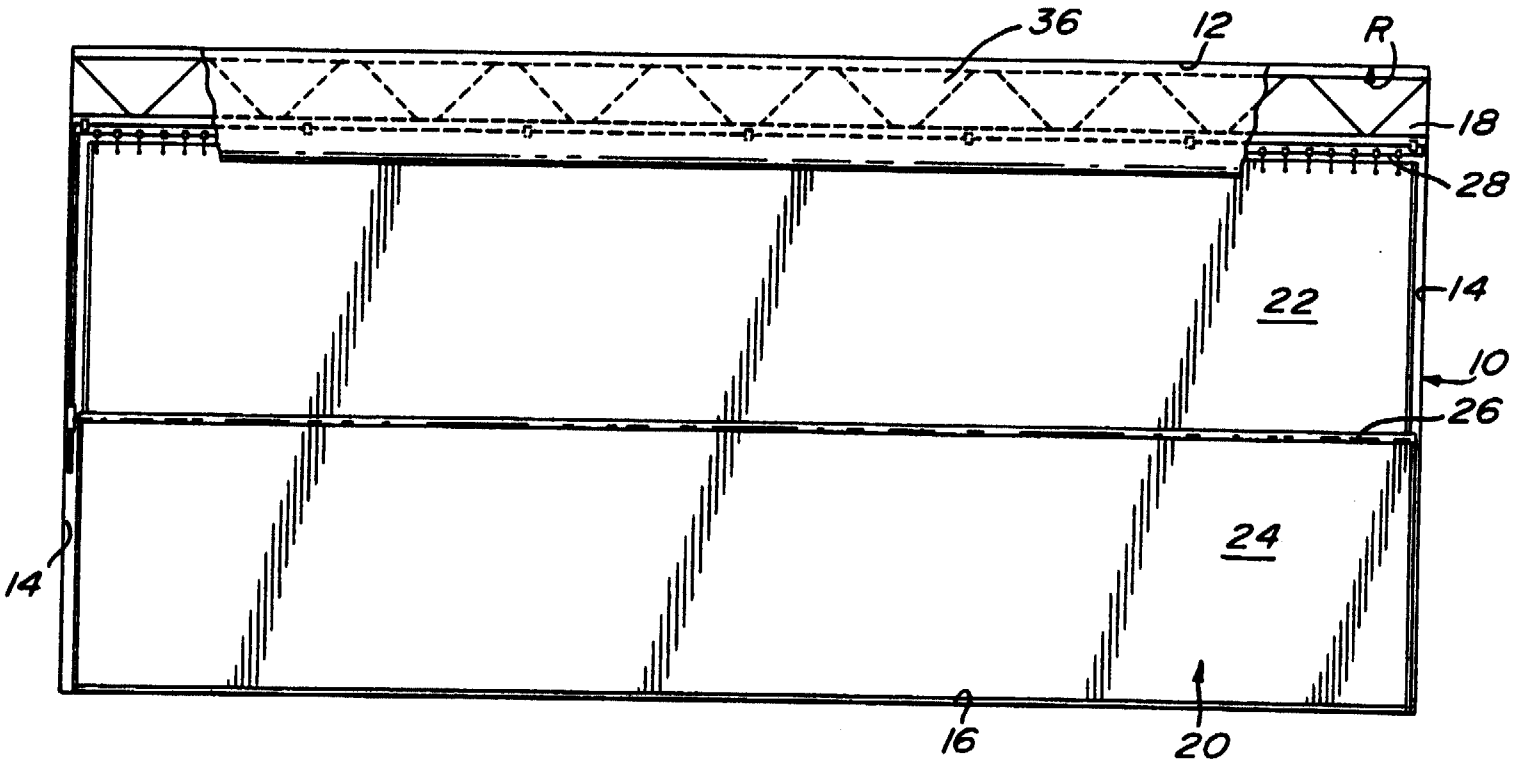
FIG. 1 is a front elevation of the flexible partition fully deployed.
Figure 2:
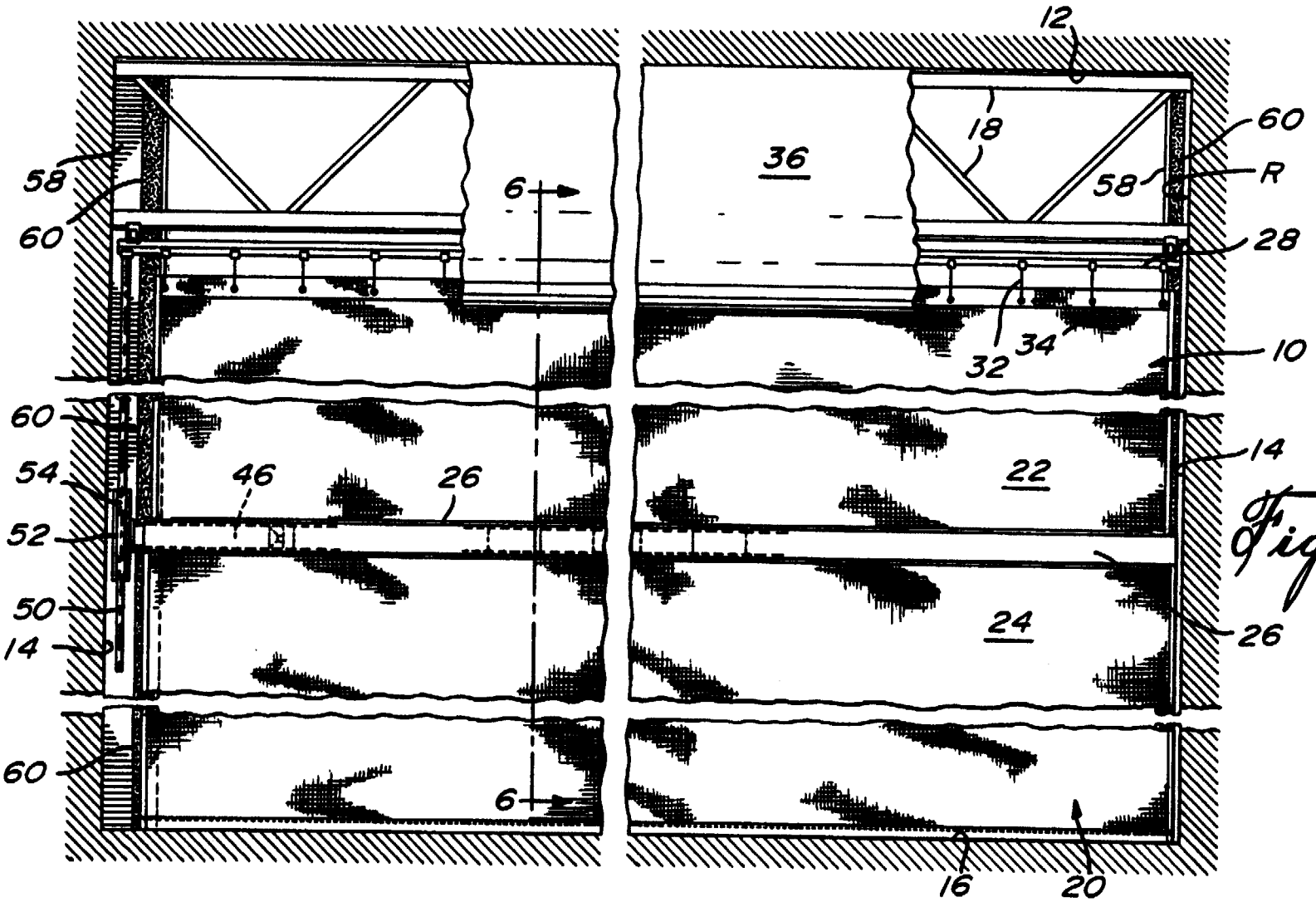
FIG. 2 is a fragmentary enlarged front elevation, similar to FIG. 1.

Referring to FIGS. 1 and 2, there is shown a flexible partition 10 being fully deployed in a room R. The room R might be a gymnasium or other large room such as in an industrial factory or a convention hall. The room R includes a ceiling 12, a floor 16, and side walls 14. In the present embodiment, the partition 10 is shown as being hung from a truss girder 18 extending from one wall 14 to the other lateral side wall 14 and supporting the ceiling 12.

The flexible partition includes a curtain 20 which in this case is made up of an upper portion 22 and a lower portion 24. A cylinder 26 separates the upper portion 22 from the lower portion 24 as will be described further. The flexible curtain 20 might be made up of 18 oz. reinforced polyester in vinyl or reinforced nylon in urethane.

Figure 3:
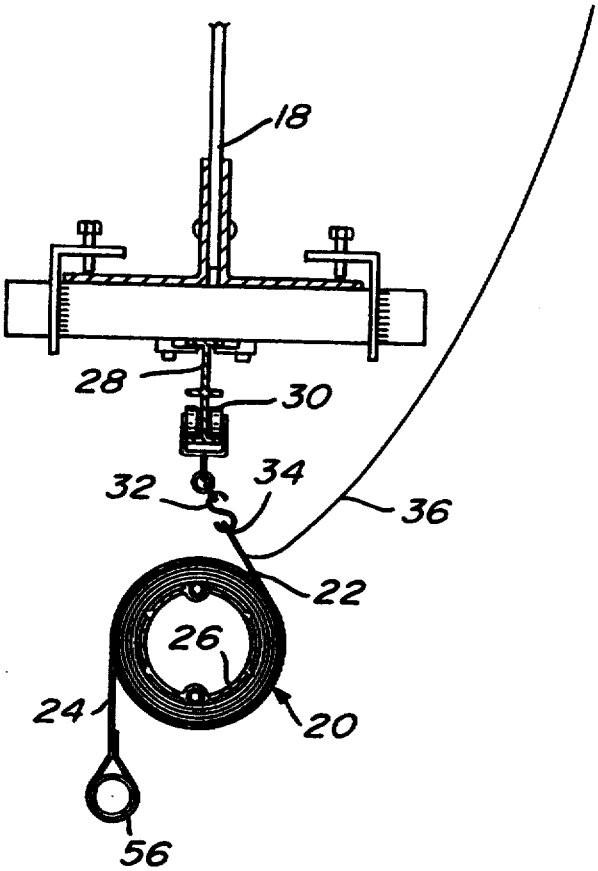
FIG. 3 is a vertical cross-section, taken laterally of the flexible partition fully wound up.

Referring now to FIG. 3, the upper edge of the curtain 20 is suspended from the girder 18 by means of a track 28. Roller brackets 30 each include hangers 32 which fit in grommets 34 provided near the upper edge of the upper portion 22 of the curtain 20.

Figure 6:
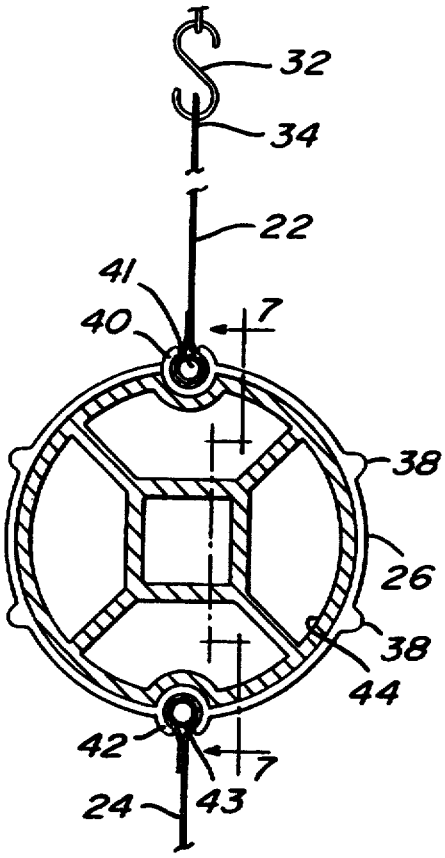
FIG. 6 is a fragmentary vertical cross-section, taken along line 6—6 of FIG. 2.

The wind-up cylinder 26 may be a thin walled aluminum extrusion including longitudinally extending ribs 38 and a pair of diametrically opposed grooves 40 and 42 adapted to receive respective beads 41 and 43 of the upper portion 22 and lower portion 24 respectively. As shown in FIG. 6, the configuration of the grooves and the beads allows the beads 41 and 43 to be locked into the grooves 40 and 42.

Figure 4:
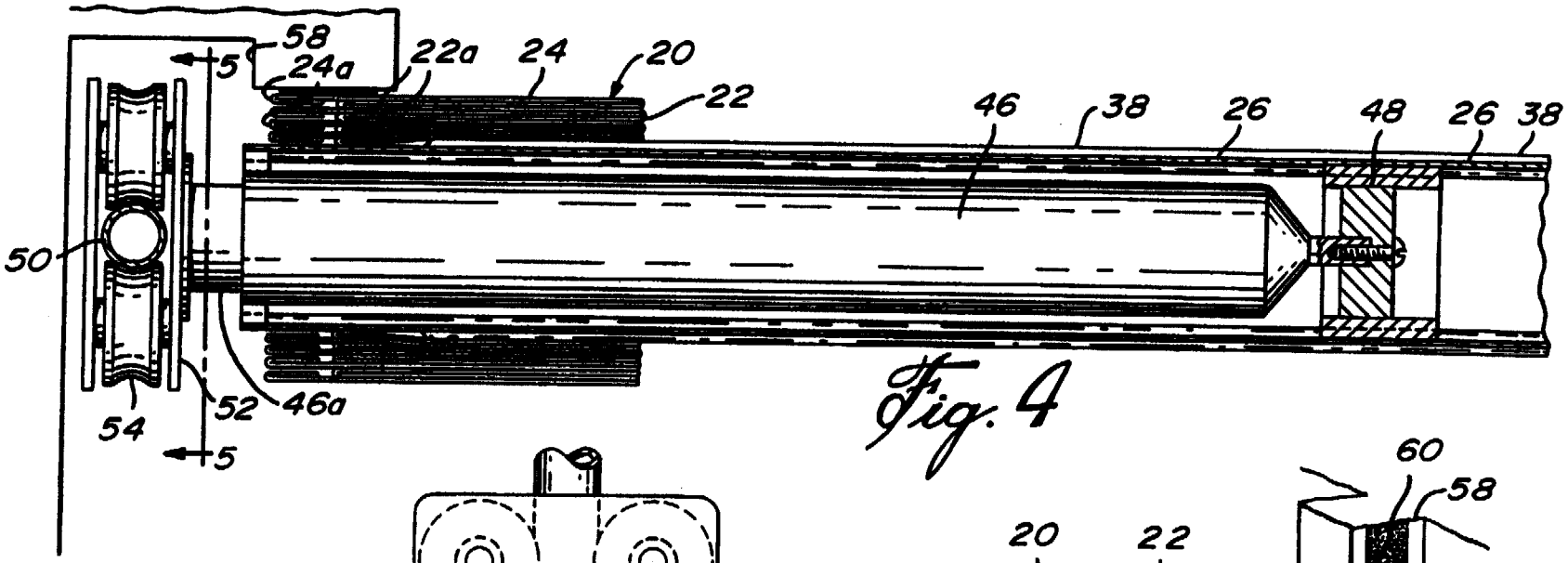
FIG. 4 is an enlarged fragmentary longitudinal cross-section of a detail of the flexible partition.

As can be seen in FIG. 4, the ends of the ribs 38 are tapered and cut away near the ends of the cylinder 26, in order to accommodate the hems 22*a* and 24*a* and the fastening strip at the edges of the curtain 20.

Figure 7:
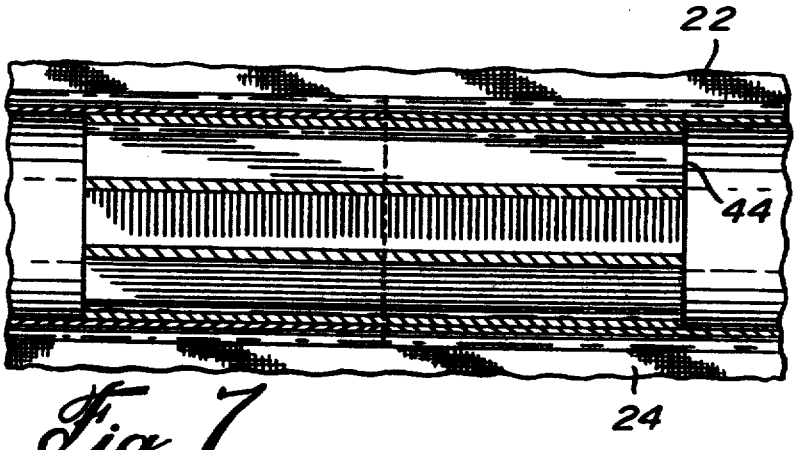
FIG. 7 is a vertical axial cross-section, taken along line 7—7 of FIG. 6.

The cylinder 26 may be supplied in 20-foot sections, and the sections are connected end to end by inserts 44 having a slightly smaller diameter than the cylinder 26. The insert 44 is shown in FIG. 7 as well as in FIG. 6.

A motor 46 is provided within the hollow portion of the cylinder at least at one end of the cylinder 26 and includes a rotary drive connection 48 as shown in FIG. 4, and the other end of the motor is connected by means of an extension 46*a* to a carriage 52 which in turn mounts four idler wheels 54. The idler wheels 54 are adapted to surround a suspended tube 50. When the motor 46 is driven to rotate the cylinder 26 by means of the rotary drive connection 48, the reaction is to resist the torque and thus to prevent the rotation of the motor provided by the carriage 52 on the suspended tube 50. It is contemplated that other torque reaction devices could be used including a fixed vertical guide member, a folding torque arm, fixed guide wires, or a retractable cable.

It is also contemplated that in the case of heavy curtains, two motors 46 would be required, one at each edge of the curtain 20.

In operation, when it is required to wind up the curtain, the motor 46 is activated to rotate the rotary drive connection 48 and thus rotate the cylinder 26. Both the upper portion 22 and the lower portion 24 of the curtain 20 will simultaneously be rolled up on the cylinder 26 as the cylinder 26 climbs on the upper portion 22.

A weight 56 may also be provided at the lower edge of the lower portion 24 in order to properly hang the curtain 20.

Figure 8:
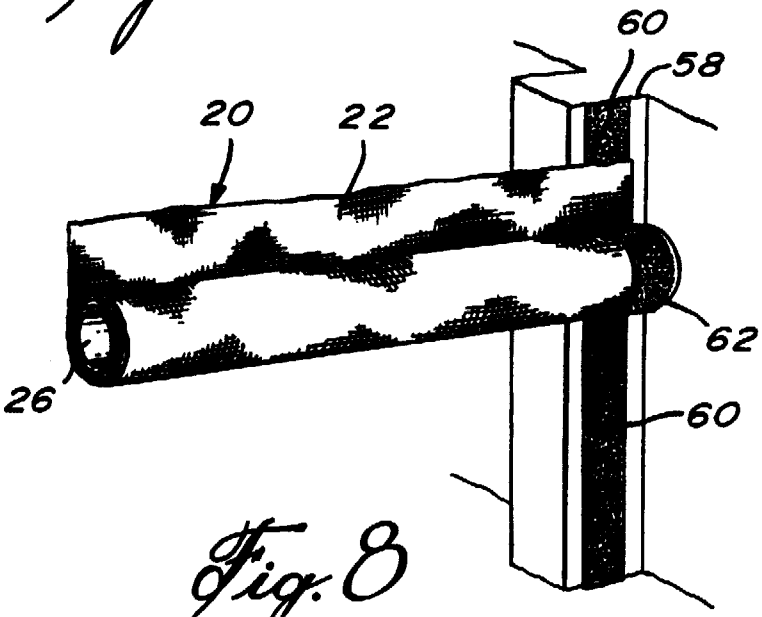
FIG. 8 is a fragmentary perspective view of the flexible partition being deployed.
Figure 5:
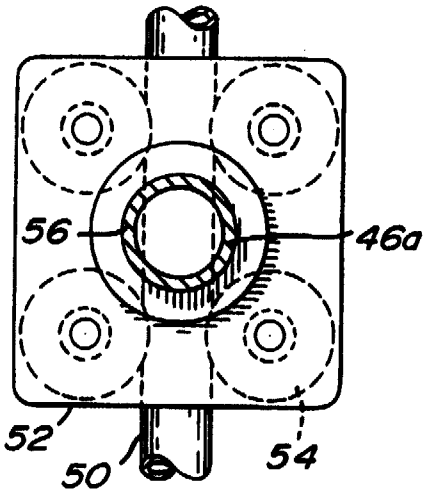
FIG. 5 is a vertical cross-section, taken along line 5—5 of FIG. 4.

In rooms where it is required to acoustically seal one divided portion from another, or where it is important to minimize the transfer of dust, it has been found advantageous to provide complementary strips of hook and loop fastening material 60 and 62 on the edges of the curtain 20 and on an alcove 58 formed on the walls 14. In such an embodiment, the wind-up cylinder 26 should be located at the bottom edge of the curtain. As shown in FIGS. 4 and 8, the curtain is easily deployed as the cylinder 26 unwinds and lays the curtain against the hook or loop strip 60 on the alcove 58. Likewise, when it is required to wind up the curtain 20, the cylinder 26 is wound up thereby stripping the curtain from the strip 60.

A valance 36 may be suspended from the ceiling 12 and connected to the upper edge of the upper portion 22 of the curtain 20, as shown in FIGS. 1, 2, and 3. The valance 36 may be provided on either side of the partition.

I claim:

1. A flexible partition for dividing a room, wherein the room includes a ceiling, a floor, and vertical side limiting means defining a vertical planar area, comprising a flexible curtain having dimensions to cover the vertical planar area and including a top edge, means for suspending the curtain from the ceiling, a bottom edge touching the floor when the curtain is fully deployed, and side edges in contact with the respective vertical limiting means, an elongated cylinder extending from one side edge of the curtain to the other fixedly connected to the curtain and dividing the curtain into an upper and lower portion, the cylinder includes a circular cross-section interrupted by diametrically opposed grooves, and a bead is located on a lower edge of the upper portion and on an upper edge of the lower portion of the curtain for fitting and locking into the respective diametrically opposed grooves such that the cylinder is bisected by a common plane of the upper and lower portions of the curtain when the curtain is fully deployed, motor means located within the cylinder at least at one side edge of the curtains, rotary drive means driven by the motor means and connected to the cylinder, and torque reacting means provided adjacent the one side edge of the curtain and associated with the motor means to resist rotation of the motor means with the cylinder in response to rotation of the rotary drive means, the upper and lower portions of the curtain being wound up on the cylinder when it is required to roll up the curtain.

2. A flexible partition as defined in claim 1, wherein the side edges of the curtain and the respective side limiting means are each provided with elongated cooperating hook and loop type fastening strips such that when the fastening strips on the curtain are engaged with the fastening strips on the limiting means, the curtain will be sealed when it is deployed.

3. A flexible partition as defined in claim 2, wherein the cylinder includes a plurality of spaced-apart parallel ribs extending axially on the outer surface thereof, the ribs being cut away adjacent the ends of the tube such as to accommodate the edges of the curtain and the fastening strips.

4. A flexible partition as defined in claim 1, wherein the cylinder is made up of sections arranged end to end by means of tubular inserts fitting within the hollow portions of the ends of the sections.

* * * * *